US006725510B1

(12) United States Patent
Clyburn

(10) Patent No.: US 6,725,510 B1
(45) Date of Patent: Apr. 27, 2004

(54) INCLINING COFFIN

(76) Inventor: Almetta Clyburn, 72 Van Buren St., Staten Island, NY (US) 10301

( * ) Notice: Subject to any disclaimer, the term of this patent is extended or adjusted under 35 U.S.C. 154(b) by 44 days.

(21) Appl. No.: 10/423,518

(22) Filed: Apr. 25, 2003

(51) Int. Cl.[7] ..... A61G 17/00
(52) U.S. Cl. ..... 27/12; 27/4
(58) Field of Search ..... 27/2, 4, 12; 220/677

(56) References Cited

U.S. PATENT DOCUMENTS

| | | | | | |
|---|---|---|---|---|---|
| 11,166 | A | | 6/1854 | Lyeth | |
| 756,297 | A | * | 4/1904 | Tabor et al. | 27/2 |
| 1,026,434 | A | * | 5/1912 | Franke | 27/2 |
| 2,230,433 | A | | 2/1941 | Pinto | |
| 2,449,424 | A | | 9/1948 | Stieber | |
| 2,735,157 | A | * | 2/1956 | Hotchkiss | 27/12 |
| 3,955,252 | A | | 5/1976 | Reda | |
| 4,517,713 | A | * | 5/1985 | Swallert | 27/4 |
| 4,788,757 | A | * | 12/1988 | Bethune et al. | 27/2 |
| 4,854,018 | A | * | 8/1989 | Von Bratt | 27/19 |
| 4,993,129 | A | | 2/1991 | Underwood et al. | |
| 6,094,789 | A | * | 8/2000 | Hankel et al. | 27/2 |
| 6,434,804 | B1 | | 8/2002 | Cornet et al. | |

* cited by examiner

*Primary Examiner*—William L. Miller

(57) ABSTRACT

A coffin, for allowing inclination for display of a deceased person in a natural position. The coffin has a pair of side walls that are divided at a transverse seam into first and second longitudinal portions. The side walls have top and bottom edges which are planar across the seam when in a planar position, and are hingeably attached at the top edges to allow the first portion to be inclined with respect to the second portion. A brace assembly maintains the coffin in its inclined position. Bellows conceal the brace assembly to maintain the aesthetics of the coffin. Following display of the deceased person, the brace assembly is released and the coffin is returned to the planar position for transport.

5 Claims, 5 Drawing Sheets

INCLINING COFFIN

BACKGROUND OF THE INVENTION

The invention relates to an inclining coffin. More particularly, the invention relates to a coffin that has a first portion that may be raised to an inclined angle to support a deceased person in a more natural position.

When people pass away it is a common custom for loved ones to view the body of the deceased person while situated within the coffin of their ultimate burial. In particular, 'open casket' wakes and ceremonies are commonplace throughout the western world.

A typical coffin is rectangular in shape, and beside upholstery and bolters found in more expensive models, the deceased is generally laid flat. This is however a relatively unnatural position, and can be quite upsetting for a person to view their beloved in this manner.

U.S. Pat. No. 6,434,804 to Cornet et al.; U.S. Pat. No. 4,993,129 to Underwood et al.; U.S. Pat. No. 3,955,252 to Reda; U.S. Pat. No. 2,449,424 to Stieber; and U.S. Pat. No. 2,230,433 to Pinto all discloses schemes for inclining the deceased within a coffin. All of these schemes, however, employ complex systems that are mounted within the coffin which attempt to provide a desirable result.

U.S. Pat. No. 11,166 to Lyeth discloses a coffin. Upon cursory examination, Lyeth appears to disclose a two-piece coffin, which seem to have hardware to detach said pieces. Closer examination, however, reveals that the hardware in Lyeth is simply a primitive scheme for permanently affixing multiple panels used to create the coffin.

While these units may be suitable for the particular purpose employed, or for general use, they would not be as suitable for the purposes of the present invention as disclosed hereafter.

SUMMARY OF THE INVENTION

It is an object of the invention to produce a coffin that is capable of inclining a portion thereof, so that the deceased is supported in an inclined position. Accordingly, the coffin has a bipartite construction—namely having a first longitudinal portion and a second longitudinal portion, which are hingeably attached to allow the first portion to be angularly raised with respect to the second portion, so that an upper portion of the deceased may be raised at an angle to the lower portion of the deceased.

It is another object of the invention to provide a coffin that can be maintained in the raised position. Accordingly, at least one bracing assembly is provided which is easily operable to support the first portion in the raised position when desired.

It is yet another object of the invention to provide a coffin provides a pleasing external appearance that conceals hardware used to incline the first portion. Accordingly, bellows are provided, extending on the sides of the coffin between the first and second portions thereof, to conceal the bracing assembly and the gap created between the first and second portions when the first portion is inclined with respect to the second portion.

It is a still further object of the invention that the coffin may be lowered to a level position, and then secured in that position for burial. Accordingly, the bracing assembly may be easily disengaged, and a bracket is provided on the bottom portion opposite the hinges that facilitates permanent attachment of first and second portions for burial.

The invention is a coffin, for allowing inclination for display of a deceased person in a natural position. The coffin has a pair of side walls that are divided at a transverse seam into first and second longitudinal portions. The side walls have top and bottom edges which are planar across the seam when in a planar position, and are hingeably attached at the top edges to allow the first portion to be inclined with respect to the second portion. A brace assembly maintains the coffin in its inclined position. Bellows conceal the brace assembly to maintain the aesthetics of the coffin. Following display of the deceased person, the brace assembly is released and the coffin is returned to the planar position for transport.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
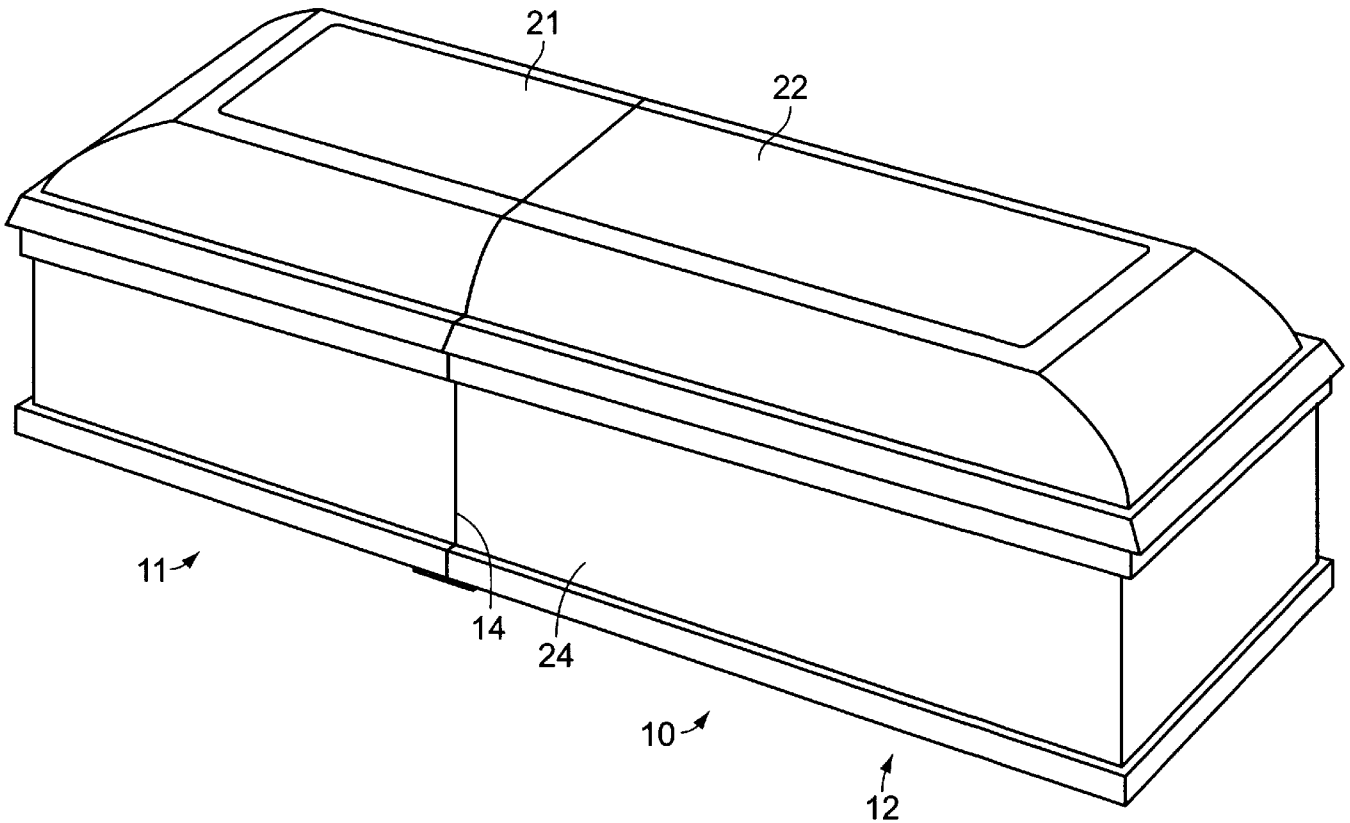
FIG. 1 is a diagrammatic perspective view, illustrating the invention per se, having first and second longitudinal portions selectively in a planar position where they together create the appearance of a standard coffin.

FIG. 1 illustrates a coffin 10, having a first longitudinal portion 11, a second longitudinal portion 12 which meet at a transversely and vertically extending seam 14 and are attached thereat for inclination of the first longitudinal portion 11 with respect to the second longitudinal portion 12. In FIG. 1, however, the coffin is shown in a planar position. The coffin 10 includes a first portion lid 21 and a second portion lid 22. The coffin 10 has a pair of longitudinally extending side walls 24, which are each divided transversely by the seam 14, and a pair of end walls 26 extending substantially perpendicularly between the side walls 24. The lids 21, 22 are each substantially aligned with both side walls 24.

Figure 2:
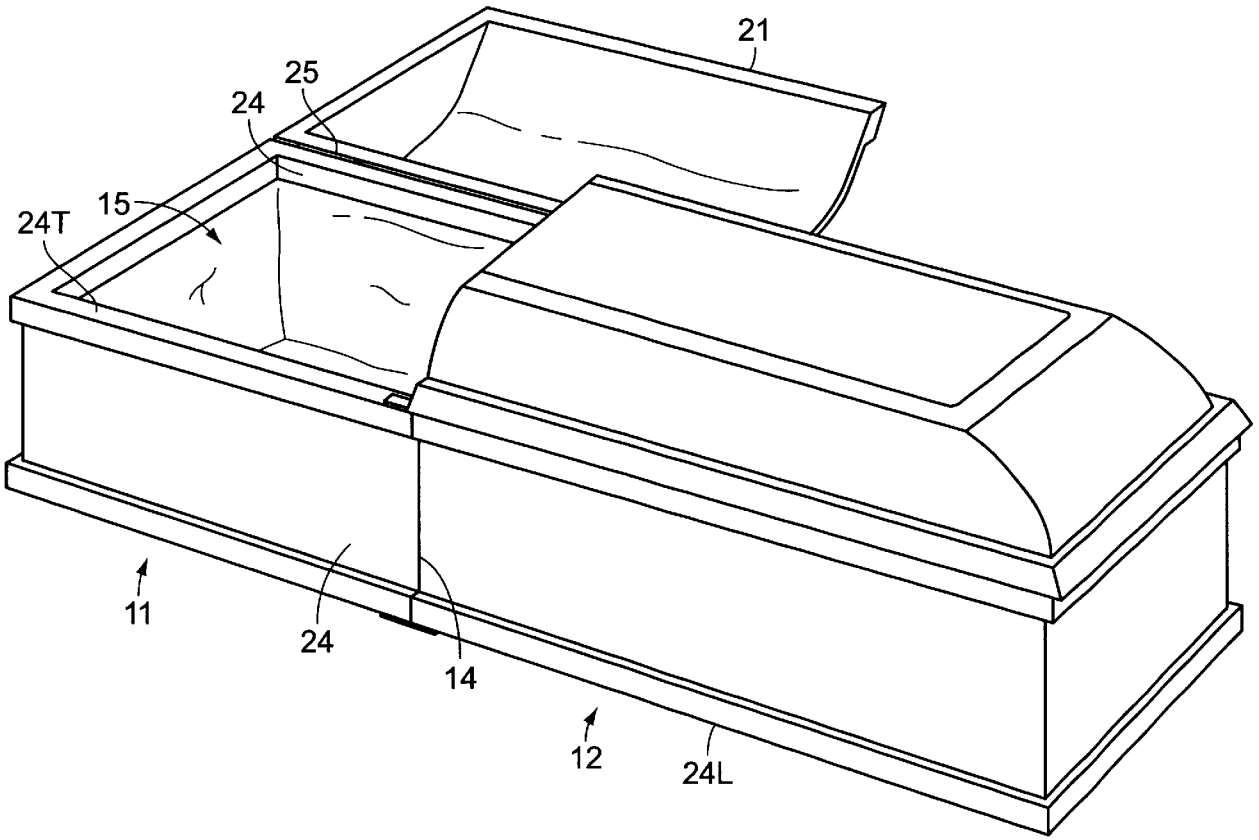
FIG. 2 is a diagrammatic perspective view, illustrating the coffin, wherein the lid of the first longitudinal portion is in the open position.

FIG. 2 illustrates the coffin 10, wherein the first portion lid 21 is open, revealing an internal volume 15, sized for containing a deceased person. The internal volume is continuous between the first and second portion 11, 12. In particular, the first portion lid 21 is attached to one of the side walls 24, which may be referred to as a hinged side 25. The first and second portion lids 21, 22 are independently openable at the hinged side 25. As will be apparent following the detailed description below, at the hinged side 25 the first portion lid 21 should be staggered slightly outward of the second portion lid 22 to prevent interference between the lids 21, 22 during inclination of the coffin. The side walls 24 have a top edge 24T upon which the lids 21, 22 are substantially aligned, and a lower edge 24L. In addition, the top edge 24T and bottom edge 24L are substantially aligned and planar across the seam 14 when the coffin is in the planar position, as shown in FIG. 1 and FIG. 2.

Figure 3:
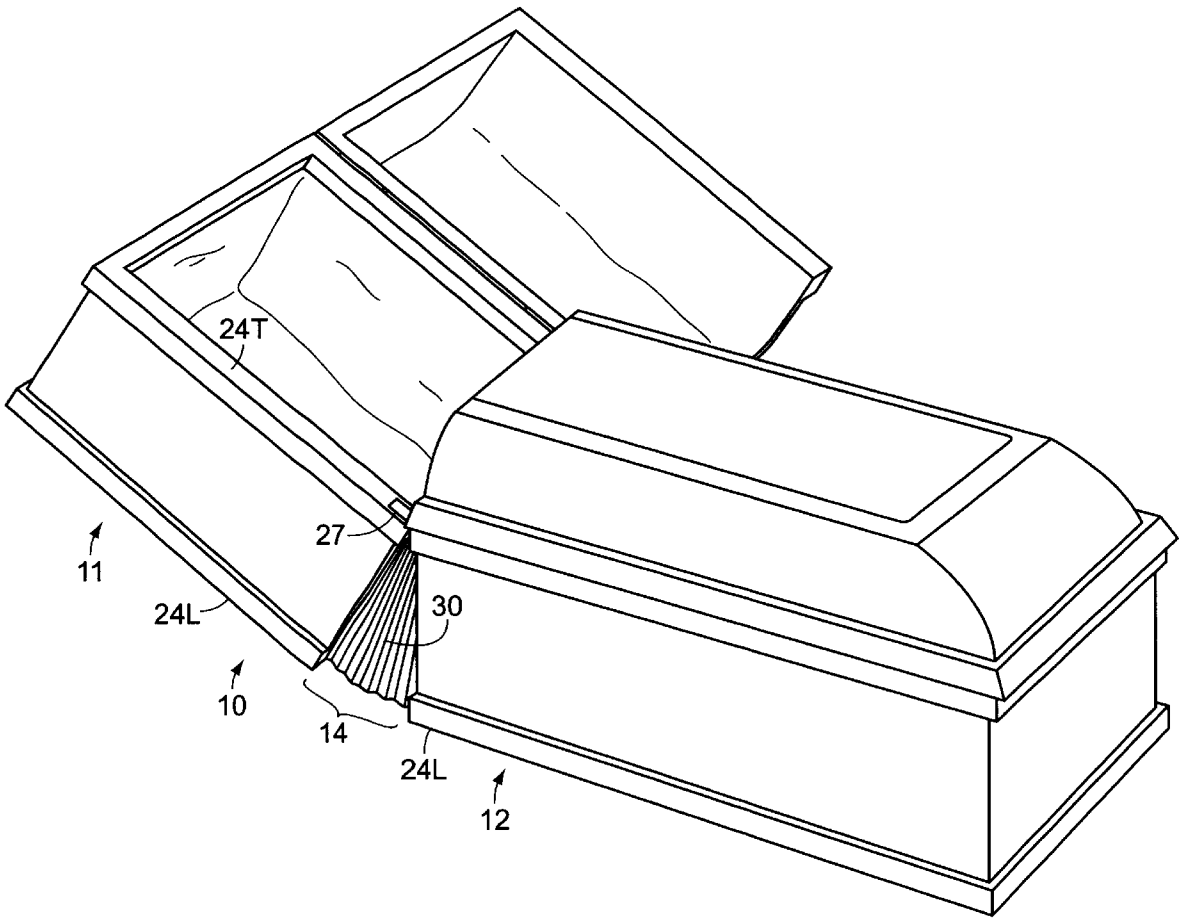
FIG. 3 is a diagrammatic perspective view, illustrating the coffin according to the present invention, wherein the first longitudinal portion has been inclined with respect to the second longitudinal portion, and wherein the bellows has expanded at the lower edge of the coffin to cover the angular gap created by said inclination.
Figure 4:
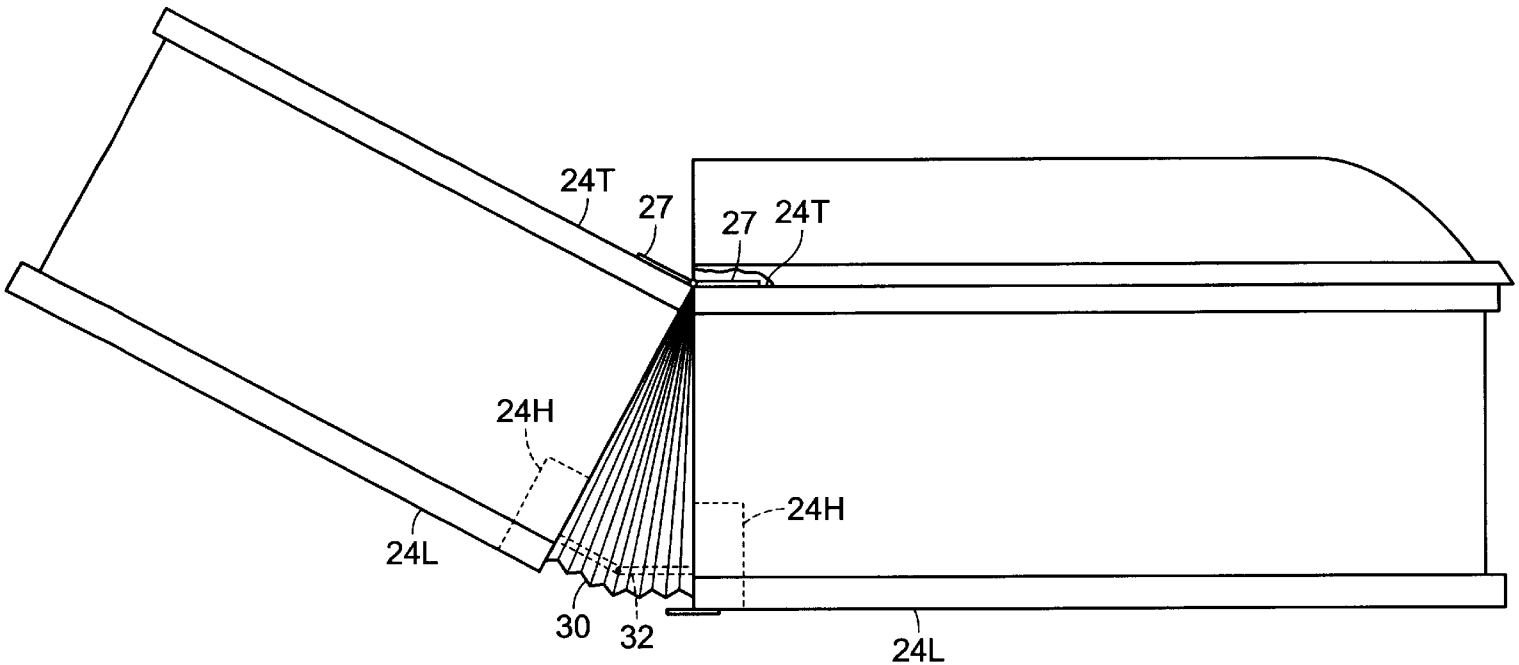
FIG. 4 is a side elevational view, similar to FIG. 3, showing the brace mounted within internal hollows within the side walls of the coffin. The brace maintains the coffin in the inclined position as desired.

FIG. 3 and FIG. 4, however, illustrate the coffin 10 in an inclined position, wherein the first portion 11 is inclined with respect to the second portion 12. In particular, the first portion 11 is hingeably attached to the second portion 12 at the top edge 24T of both side walls 24, with a pair of inclination hinges 27, only one of which is visible in the drawing figures. Each of the inclination hinges 27 is rigidly attached to both the first and second portions 11, 12, and is configured to allow angular movement therebetween. As a result, the coffin can enter a position wherein the first portion 11 is angularly raised with respect to the second portion, so that the deceased can be displayed in a more natural position—perhaps bent at the waist. The first portion 11 creates an angular gap at the seam 14 that has an origin at the top edge 24T, and is widest at the lower edge 24L. Thus to retain aesthetics, bellows 30 are mounted between the side walls 24, such that they remain substantially compressed near the top edge 24T and are substantially expanded near the lower edge 24L.

To maintain the coffin 10 in the inclined position, a brace assembly 32 is provided. In particular, referring to FIG. 5, the brace assembly 32 includes a pair of arms 34 which are attached at a central pivot 36, and are each attached opposite the central pivot 36 to the side wall 24 of one of the first longitudinal portion 11 and second longitudinal portion 12. To conceal the brace assembly 32, each side wall 24, has an inner wall 24A and an outer wall 24B, and a hollow 24H therebetween that is open at and toward the seam 14. The hollows 24H are sized to allow the brace assembly 32 to freely operate therein between a locked position, as shown in FIG. 5 wherein they support the first longitudinal portion 11 during its inclination; and a relaxed position, as shown in FIG. 6, wherein the first longitudinal portion 11 can be lowered to the planar position for transport.

Figure 5:
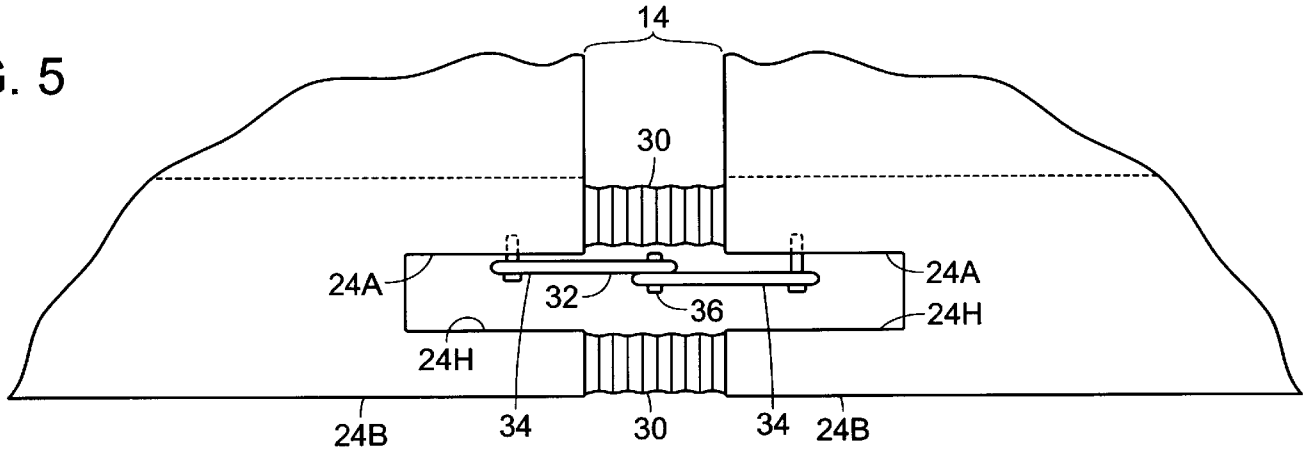
FIG. 5 is a bottom plan view, illustrating the brace mounted to both the first longitudinal portion and the second longitudinal portion within the hollows thereof, and showing the bellows extending between respective portions of the inner and outer walls.

Further illustrated in FIG. 5, the bellows 30 may be a pair of bellows which each extend between the first and second portion 11, 12 at either the inner side wall 24A or outer side wall 24B. Thus, the brace assembly 32, and gap created by the widened seam 14 is concealed both from outside and inside the coffin.

Figure 6:
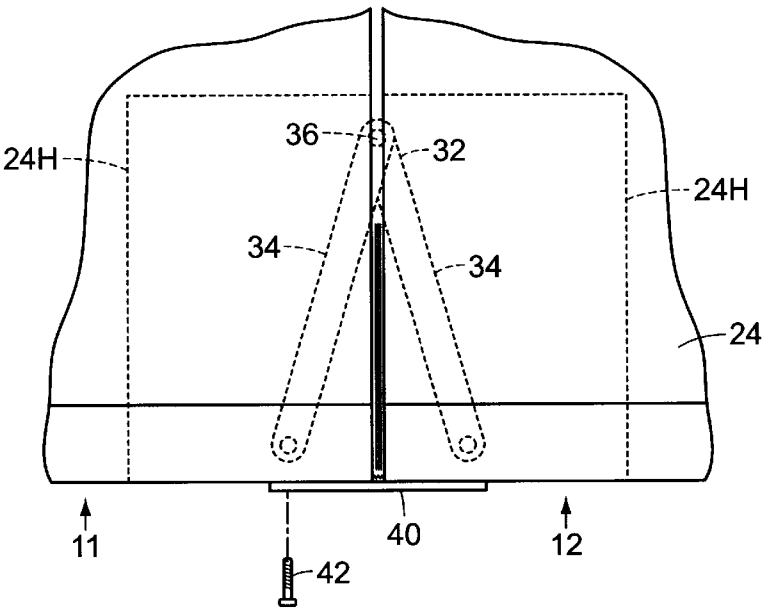
FIG. 6 is a side elevational view, wherein the brace has been collapsed to allow the coffin to decline to a planar position where it resembles a standard coffin. A lower bracket and screw fastener is being used to keep the coffin in the planar position during transport.

FIG. 6 further illustrates a lower bracket 40, which extends immediately beneath the lower edge 24L of both the first and second portion 11, 12 when in the planar position. The lower bracket 40 is rigidly attached to one of the first and second longitudinal portions 11, 12, and then is selectively attached to the other of the first and second longitudinal portion 11, 12 with a fastener, such as a fastening screw 42. Thus, the lower bracket 40 'locks' the coffin to prevent inadvertent inclination during transport and burial. In FIG. 6, clearly, the lower bracket 40 is rigidly attached to the second longitudinal portion 12, and is being attached to the first longitudinal portion 11 with the fastening screw 42 after the coffin has been lowered to the planar position for safe transport.

In conclusion, herein is presented a coffin which is capable of inclining a first portion thereof to allow a deceased person to be displayed in a natural position, and then is subsequently lowered for transport of the coffin. The invention is illustrated by example in the attached drawing figures and in the foregoing description. Numerous variations are possible, while adhering to the inventive concept. Such variations, however, are contemplated as being a part of the present invention.

What is claimed is:

1. A coffin, comprising:

a pair of longitudinally extending side walls, each having a top edge and a lower edge, a pair of end walls extending substantially perpendicularly between the side walls, the side walls and end walls together defining an internal volume for containing a deceased person, the side walls divided transversely by a seam to define a first longitudinal portion and a second longitudinal portion, the top edge and lower edge are substantially planar between the first longitudinal portion and second longitudinal portion when the coffin is selectively in a planar position;

a pair of inclination hinges, each mounted at the top edge between the first longitudinal portion and a second longitudinal portion, the inclination hinges allow the first longitudinal portion to enter an inclined position wherein the first longitudinal portion is inclined with respect to the second longitudinal portion, creating an angular gap with an origin at the top edge;

a bracing assembly for selectively maintaining the first longitudinal portion in the inclined position; and a mechanism for selectively concealing the angular gap.

2. The coffin as recited in claim 1, wherein the mechanism for selectively concealing the angular gap are bellows mounted between the first longitudinal portion and second longitudinal portion at the seam therebetween.

3. The coffin as recited in claim 2, wherein each of the side walls has an inner side wall and an outer side wall, and defines a hollow that is open at the seam; wherein the bracing assembly extends within the hollow and is attached to both the first longitudinal portion and second longitudinal portion; and wherein the bellows extend between the outer side walls adjacent the seam to conceals the hollow and thereby conceal the bracing assembly extending within the hollow and between the first and second longitudinal portions.

4. The coffin as recited in claim 3, further comprising a pair of lower brackets, extending against the lower edge between the first and second longitudinal portions when the coffin is in the planar position, for selectively preventing the first longitudinal portion from inclining during transport of the coffin.

5. The coffin as recited in claim 4, wherein the lower bracket is rigidly attached to one of the first and the second longitudinal portions, and is selectively attachable to the other of the first and second longitudinal portions once the first longitudinal portion has been lowered to the planar position to facilitate safe transport of the coffin.

* * * * *